United States Patent [19]

Petrie

[11] Patent Number: 5,074,225

[45] Date of Patent: Dec. 24, 1991

[54] MECHANISM FOR FEEDING SOLID MATERIALS

[76] Inventor: A. Stephen Petrie, 31 Evelyn Avenue, Toronto, Ontario, Canada, M6P 2Z2

[21] Appl. No.: 423,342

[22] Filed: Oct. 18, 1989

[51] Int. Cl.[5] ..... F23K 3/00

[52] U.S. Cl. ..... 110/101 R; 110/108; 110/293; 414/196

[58] Field of Search ..... 110/293, 101 R, 108, 110/118; 126/7, 10, 11, 68, 73, 74; 198/624; 414/196, 172

[56] References Cited

U.S. PATENT DOCUMENTS

| | | | |
|---|---|---|---|
| 236,465 | 1/1881 | Spreckels | 110/118 |
| 305,450 | 9/1884 | Hibbard | 110/118 |
| 528,958 | 11/1894 | Lister . | |
| 794,853 | 7/1905 | Cox . | |
| 941,486 | 11/1909 | Andersen | 414/196 |
| 1,152,363 | 8/1915 | Weisberger . | |
| 1,183,797 | 5/1916 | Carpenter et al. . | |
| 1,312,526 | 8/1919 | Ely | 110/118 |
| 1,935,876 | 11/1933 | Greenawalt | 214/18 |
| 2,102,544 | 12/1937 | Ralsch | 110/108 |
| 2,106,469 | 1/1938 | Seil | 214/21 |
| 2,214,740 | 9/1940 | Harrington | 110/38 |
| 4,126,119 | 11/1978 | Fike | 126/124 |
| 4,185,567 | 1/1980 | Grossniklaus | 110/101 |
| 4,257,461 | 3/1981 | Wangeby et al. | 198/624 |
| 4,321,877 | 3/1982 | Schmidt et al. | 110/108 |
| 4,444,538 | 4/1984 | Manley | 414/176 |
| 4,524,810 | 6/1985 | Arnold | 198/624 |
| 4,530,289 | 7/1985 | Godbout | 110/117 |
| 4,606,282 | 8/1986 | Steindal | 110/116 |

*Primary Examiner*—Henry A. Bennet
*Assistant Examiner*—Denise L. F. Gromada
*Attorney, Agent, or Firm*—Willian Brinks Olds Hofer Gilson & Lione

[57] ABSTRACT

A mechanism for feeding solid material, e.g. wood in a wood-burning furnace, has a pair of rollers. The rollers are rotatably mounted, so as to be generally horizontal and substantially parallel to one another. The rollers are spaced apart to permit the solid material to fall between them. Thus, in a furnace, they are far enough apart to permit logs to fall from a store into a combustion chamber, but are also sufficiently close that, in the absence of roller motion, the material tends to bridge between the rollers. A drive is provided for rotating the rollers.

50 Claims, 5 Drawing Sheets

MECHANISM FOR FEEDING SOLID MATERIALS

FIELD OF THE INVENTION

This invention relates to a mechanism for feeding a bulk discrete solid but not naturally free flowing material into a chamber, and more particularly relates to a mechanism for feeding logs to the combustion chamber of a wood-burning furnace.

BACKGROUND OF THE INVENTION

At the present time, there are a variety of furnaces and heating systems available for heating buildings, particularly houses or single family dwellings.

Commonly, in most developed countries, fossil fuel is used, e.g. oil, gas, coal or coke. The latter two fuels have become less common for domestic use, due to handling problems. It is difficult and expensive to provide any sort of automatic handling and feeding arrangement for such solid fuels. Oil and gas, on the other hand, have the advantage that, being fluids, it is a relatively simple matter to regulate their flow to a furnace or water heater. As a consequence, boilers and water heaters and other heating appliances fueled by oil and gas can be run automatically and left unattended for long periods. Oil and gas can both be stored in relatively large quantities and a combustion chamber configuration for automatic operation can readily be designed.

At the present time, the use of wood as a fuel is regaining popularity in various parts of North America and elsewhere. In many developing countries, and underdeveloped countries, wood is a significant energy source. In appropriate areas, it has the advantage that it is readily available and relatively inexpensive. Typically, in a house or single unit dwelling, the wood is burnt in a fireplace, which may be open or closed, or in a freestanding wood stove. Water heating units can be incorporated, as desired. Wood, however, like coal and coke, suffers from the disadvantage of being a solid fuel. This makes it necessary to manually fuel a heating unit at regular intervals. Also, wood has a relatively low heat value per unit volume, necessitating relatively frequent fueling of the stove or furnace.

The requirements of a particular heating situation will determine the operating power output desired of the solid fuel appliance. For convenience, the wood-burning appliance must require only infrequent refuelling. In a conventional wood-burning furnace, it is quite difficult to maintain both an efficient fire and combustion for any length of time. Pellet-burning appliances are an exception, as they mostly use an auger to transport fuel from a fuel store to the combustion chamber. Such an arrangement is not suitable for wood in the form of logs.

In the majority of contemporary log-burning devices, the primary combustion chamber also serves as the sole integral fuel store. To provide sufficient fuel store capacity requires an increase in the size of the primary combustion chamber far beyond the optimum size for efficient combustion at the desired operating power output.

Efficient combustion requires temperatures high enough to achieve ignition of the volatile (i.e. non-carbon) fuel constituents. This usually means that the fuel everywhere in the combustion chamber will all be burning at approximately the same stage of combustion at all times. When the combustion chamber is sized to provide an adequate fuel store, there is far too much fuel for efficient simultaneous combustion at the desired power output. Thus, operating a large combustion chamber with a restricted air supply and low combustion rate, to give longer periods between refuelling, simply results in inefficient combustion. Inefficient combustion brings increased fuel costs and defeats the desired objective of infrequent refuelling. Also, because uncombusted material is deposited in the flue or exhausted to atmosphere, it brings greater flue fire hazard and increased pollutant emissions.

The problem with log-burning devices is to provide a fuel store that is separate from the combustion chamber, but integral with the appliance as a whole, and to provide a simple and reliable feed to the combustion chamber.

U.S. Pat. No. 528,958 shows rotary elements for grate of a boiler furnace, but is not concerned with the feeding of fuel to the furnace.

U.S. Pat. Nos. 794,853 and 1,152,363 rely on gravity feeding, but do not address the problem of causing fuel to move downwards.

U.S. Pat. No. 183,797 shows a conveying weighing mechanism for charging machines. As such, it includes two conveyor belts whose top surfaces move towards one another.

A variety of feeding mechanisms are disclosed in some other patents. Thus the U.S. Pat. No. 1,935,876 has two hoppers with two feed rollers, which incidentally rotate in the same direction. In U.S. Pat. No. 2,106,469, cores or briquettes are discharged from receptacles onto a conveying mechanism. The conveying mechanism has belts or the like on opposite sides for driving the cores.

U.S. Pat. No. 2,214,740 shows a stoker which, as shown in FIG. 4 of that patent, has a single feed roller.

A somewhat complex feed arrangement is disclosed in the heating device of U.S. Pat. No. 4,126,119. Here, logs are fed axially into the combustion chamber.

A somewhat complex feeding arrangement is disclosed in the Grossniklaus U.S. Pat. No. 4,185,567. This is of some interest in showing the complexity that can arise when a feed other than gravitational is employed. Grossniklaus relies upon the arrangement of a ram and the fuel store beside the combustion chamber to keep the combustion gases out of the fuel store. Three separate flaps are provided for displacing the wood towards a ram, and the ram drives the wood through a feed duct into the combustion chamber.

Another complex feeding mechanism is disclosed in the U.S. Pat. No. 4,444,538. Here again logs are fed axially into the combustion zone, and the log magazine or storage is separate from the combustion zone.

Both Godbout U.S. Pat. No. 4,530,289 and Steindal U.S. Pat. No. 4,606,282 patents are of some interest, in showing a log storage magazine, which is not completely separate from the combustion chamber. In Godbout, chains are used to hold the logs at the bottom of the chamber, and air nozzles supply air to the surfaces of the logs, to generate combustion. The top of the log chamber is closed, to prevent combustion proceeding upwards through the logs. Similarly, in the Steindal patent, a log magazine is closed, so that combustion gases are forced to travel in the desired path, and not up through the logs. Here, two separate chambers are provided in a U-shape. The logs then fall under gravity to the combustion zone.

Accordingly, it is necessary to provide a wood-burning appliance which is designed for infrequent refuelling, yet provides efficient combustion at the desired power output.

SUMMARY OF THE PRESENT INVENTION

Accordingly, it is desirable to provide a feed mechanism, for a log-burning furnace or the like, which is simple and robust, and is capable of reliably feeding wood from a storage chamber or magazine to the combustion chamber. The mechanism should be capable of handling wood having a variety of different sizes and shapes, without becoming jammed.

In accordance with the first aspect of the present invention, there is provided a mechanism, for feeding a bulk discrete solid but not naturally free flowing material into a chamber. There are first and second rollers adapted to be mounted above the chamber and below a store for the material. The rollers are rotatably mounted and extend generally horizontally and parallel to one another. They are spaced apart sufficiently to enable solid fuel to fall between them. They are also sufficiently close so that, in the absence of roller motion, the material tends to bridge between the rollers. There are also drive means coupled to the rollers for rotating the rollers.

Preferably, the rollers are toothed, with the teeth being provided by toothed annular discs. Also, guard plates are preferably provided, covering the rollers and having slots for the toothed annular discs.

In a wood-burning furnace, the mechanism serves to ensure that logs fall down from a wood store or magazine into a combustion chamber. There are many different roller operating modes which may be utilized. The rollers may be allowed to rotate at the same time, i.e. concurrently, or the rollers may be operated sequentially, one after the other. Similarly, the rollers may alternately be rotated in opposite directions in an oscillating fashion (which introduces the notion of roller "cycles"), or they may simply rotate unidirectionally. A third factor may be introduced, the rollers may rotate in the same direction or in opposite directions during a single cycle. Finally, where concurrent roller action is presumed, either or both of the rollers may be powered by the drive means. This introduces many possible roller action modes. Preferably the rollers should not continuously and simultaneously urge the solid material downwards as this may cause the mechanism to jam.

It has been found that unidirectional roller rotation, with both rollers turning in the same direction, whether concurrent or sequential, results in smooth operation as one roller tends to urge the logs downward and towards the gap between the rollers, while the other roller urges the logo upwards and away from the gap. This "jostling" of the logs may be enhanced by introducing cycling action through oscillation.

Another aspect of the present invention provides a furnace comprising a housing defining a combustion chamber in a lower part of the housing and a store for solid fuel in an upper part of the housing. A roller mechanism comprises first and second rollers, which are rotatably mounted and extend generally horizontally and parallel to one another between the store and the combustion chamber. The rollers are spaced apart sufficiently to enable solid fuel to fall between them into the combustion chamber but are also sufficiently close so that in the absence of roller motion, the solid material tends to bridge between the rollers. Drive means are coupled to the rollers for rotating the rollers in the same direction. There are means for supplying air into the combustion chamber and means for discharging exhaust gases from the combustion chamber. An ash collection means is provided below the combustion chamber.

Thus, in such a furnace, one can obtain both a high combustion efficiency at a desired power output and a large fuel storage capacity.

In yet another aspect of the present invention, there is provided a mechanism for feeding solid material from an upper chamber into a lower chamber. The mechanism comprises first and second rollers, adapted to be rotatably mounted. The rollers are generally horizontal and parallel to one another and spaced apart to define a throat sufficient to enable solid material to fall between them but are also sufficiently close so that, in the absence of roller motion, the solid material tends to bridge between the rollers. Drive means are coupled to the rollers for rotating the rollers in the same direction.

Thus, there are many industries in which bulk handling of discrete solid materials of a substantial size, i.e. not powders, presents problems, due to the natural tendency of the materials to become clogged and jammed. At the same time, it is often necessary to regulate the flow of a material. The present invention enables a flow control to be provided. The rollers can be spaced apart to define a throat which is somewhat wider than the largest particle or element size expected to be encountered. Usually, such solid materials will only freely flow through a relatively large cross-section and tend to become jammed where the cross-section is comparable to the size of the particles or elements. However, by use of the mechanism of the present invention, one can ensure that the material falls down through the throat between the rollers, and at the same time the rollers can be used to regulate the flow; the material will not flow through the throat in the absence of roller motion.

It is to be understood that the invention presently disclosed can be practised with bulk-discrete solid materials other than wooden logs. The particular design embodying the invention will of course be influenced by the physical properties of the material to be fed. These physical properties include density, surface friction characteristics, geometric volume and shape. In response to these material characteristics, roller spacing, roller tooth distribution, roller circumferential exposure and roller drive features would be altered. In addition, where the material to be fed consists of wooden logs, the store can be designed with jamming effect caused by the storing of the logs above the rollers. In particular the side walls of the store can be oriented such that the interior angle defined by those side walls and the top surface of the stove is greater than 90°.

BRIEF DESCRIPTION OF THE DRAWINGS

In describing a preferred embodiment of the present invention, and to show more clearly how it may be carried into effect, reference will now be made to the accompanying drawings, in which.

DESCRIPTION OF THE PREFERRED EMBODIMENT

Figure 1:
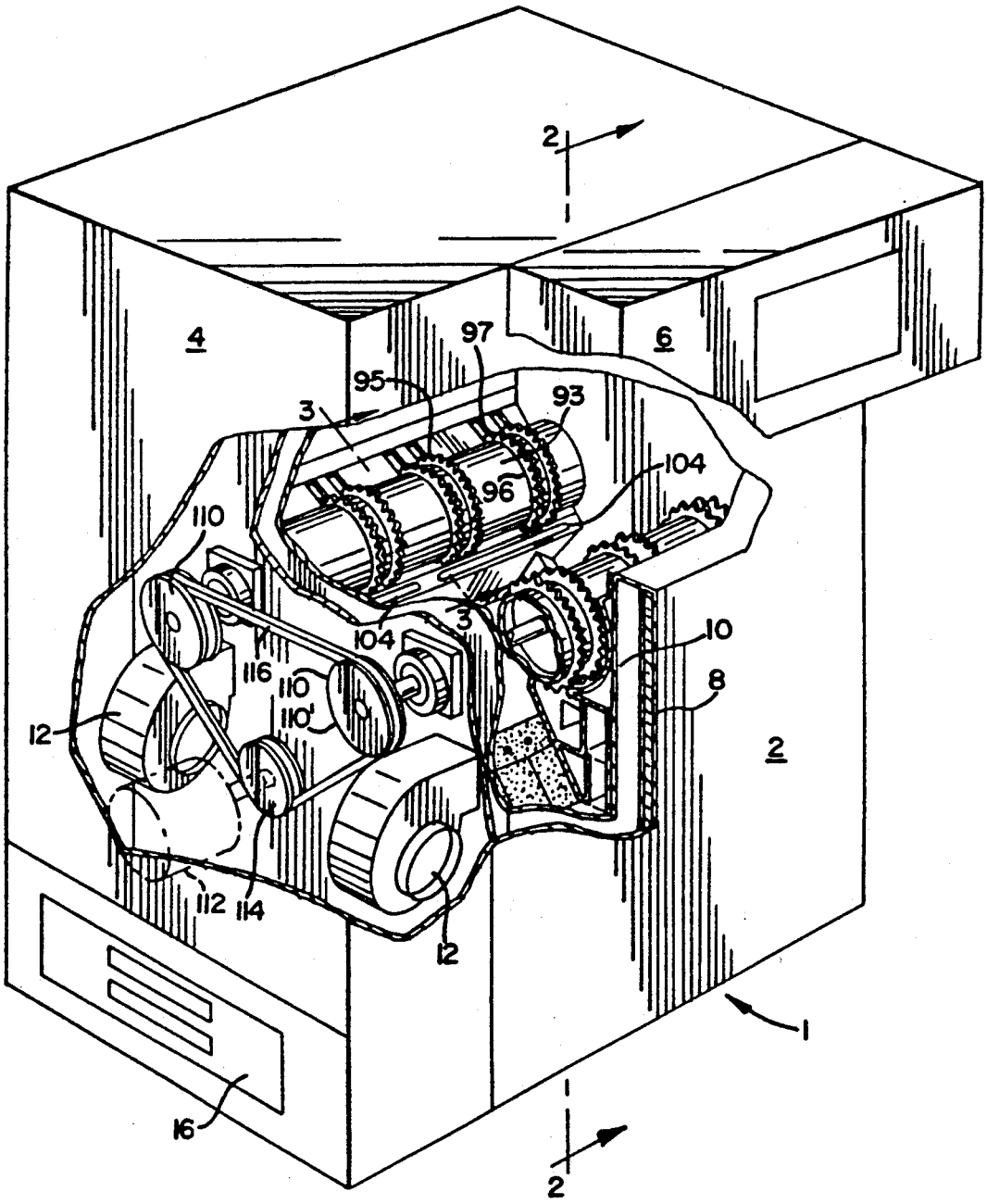
FIG. 1 is a partially cut away perspective view of a log-burning furnace in accordance with the present invention.

Referring to FIG. 1, a furnace according to the present invention is generally designated by the reference 1. The furnace comprises a lower combustion section 2 and an upper log magazine or store 4, which is continuous with the combustion section 2. The log magazine includes a supply door mechanism 6, including inner and outer doors. This mechanism is the subject of my separate copending and concurrently filed application No. 422,964 That invention is for a door mechanism for supplying solid fuel to a store of a solid fuel burning appliance and has a body defining a transfer chamber having an inlet and an outlet. An inner door is movably mounted to the body for closing the outlet thereof, the inner door normally closing off the outlet but being displaceable by solid fuel to an open position, for example against the influence of gravity. An outer door is mounted for closing off the inlet, and again is movable between a closed position and an open position. A displacement member is secured to the outer door. The displacement member is dimensioned so as to displace fuel from the transfer chamber through the outlet, as the outer door is closed. The door mechanism is not described in greater detail here.

As shown, the walls of the combustion section are well insulated as indicated at 8 and the log magazine walls would be similarly insulated. Also, the walls are provided with hollow sections 10, through which cooling air may flow, the cooling air being return air from the heated space.

Figure 2:
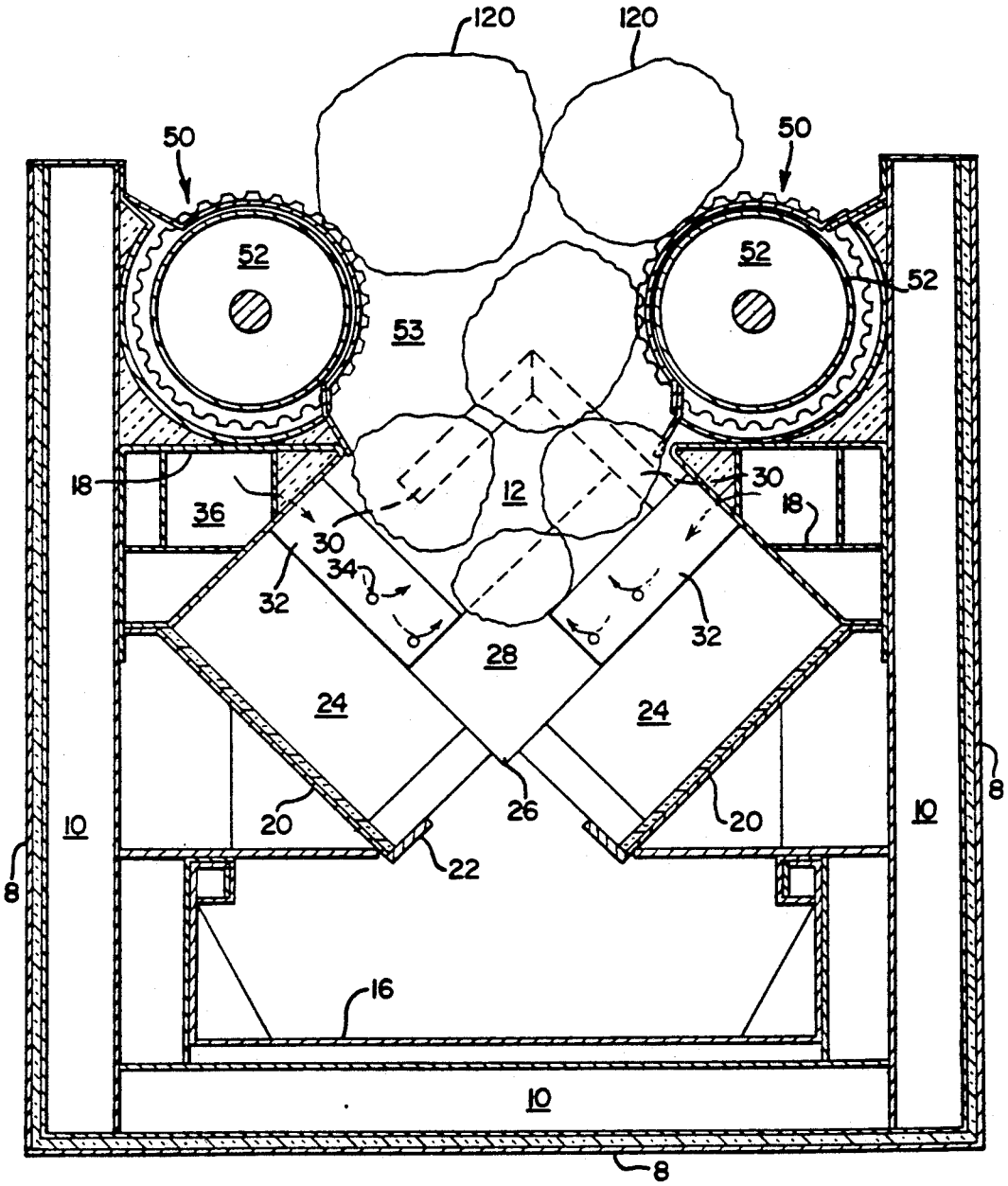
FIG. 2 is a vertical sectional view of a lower combustion chamber of the furnace of FIG. 1 along the line 2—2.

At the front, there are two similar blowers 12 for supplying combustion air to the combustion chamber 14 as shown in FIG. 2 within the combustion section. The blowers are centrifugal fans. At the bottom of the combustion section, there is an ash drawer 16.

Referring to FIG. 2, the combustion chamber is partially defined by various steel plates, indicated at 18, which may be bolted or welded together. The steel plates form two sloping bottom walls 20 including edge plates 22. Fire bricks 24 are located on these bottom walls and retained by the edge plates to define the bottom of the combustion chamber and a narrow slot 26 through which ash and small pieces of charcoal can fall. Gaseous products also pass through the slot although they may be taken off elsewhere. At either end of the combustion chamber end fire bricks 28 are provided, which are held in place by suitable metal angle sections 30.

On top of the bottom fire bricks there are a series of air supply ducts 32. There are three air supply ducts on each side. Each air supply duct includes a number of small openings 34 for the combustion air. The air supply ducts are connected to a passageway 36 for the combustion air. Although not completely shown, the passageway 36 may be divided by vertical partitions into three approximately equal sections. Each of these cross-sections would then be connected with one associated air supply duct. Each passageway is connected to a respective air supply blower.

As shown in FIG. 2, the ash drawer is located below the opening for ash. The drawer 16 would be mounted on suitable runners or the like to enable it to be pulled out for emptying.

Above the combustion chamber, and in accordance with the present invention, there is a roller mechanism 50, below the log store (FIG. 1). The roller mechanism comprises a pair of rollers 52. These rollers are generally identical, and for simplicity, one roller, namely the left hand one, is described in detail. The other roller and its associated components essentially constitute a symmetrical or a mirror image of the left hand roller and its components.

The left hand roller and its associated components are described primarily by reference to FIGS. 2, 3, 4 and 5. The roller comprises a main body 54 and forward and rear stub shafts 56, 58. The rollers define a throat 53, for controlling the downward movement of logs as detailed below.

The main body is in the form of a cylinder with circular end walls 60 and a central wall 62. The roller may have one or more hollow portions filled with insulation material. The various components are formed of steel and welded to one another. As described in greater detail below, a plurality of toothed annular discs 64 are welded to the exterior of the cylindrical body 54. Tapered screw sockets 66 are provided in the end walls. The ends 68 of the two shafts are provided with corresponding tapered screw threads. Nuts and lock washers are also provided, in known manner.

Figure 4:
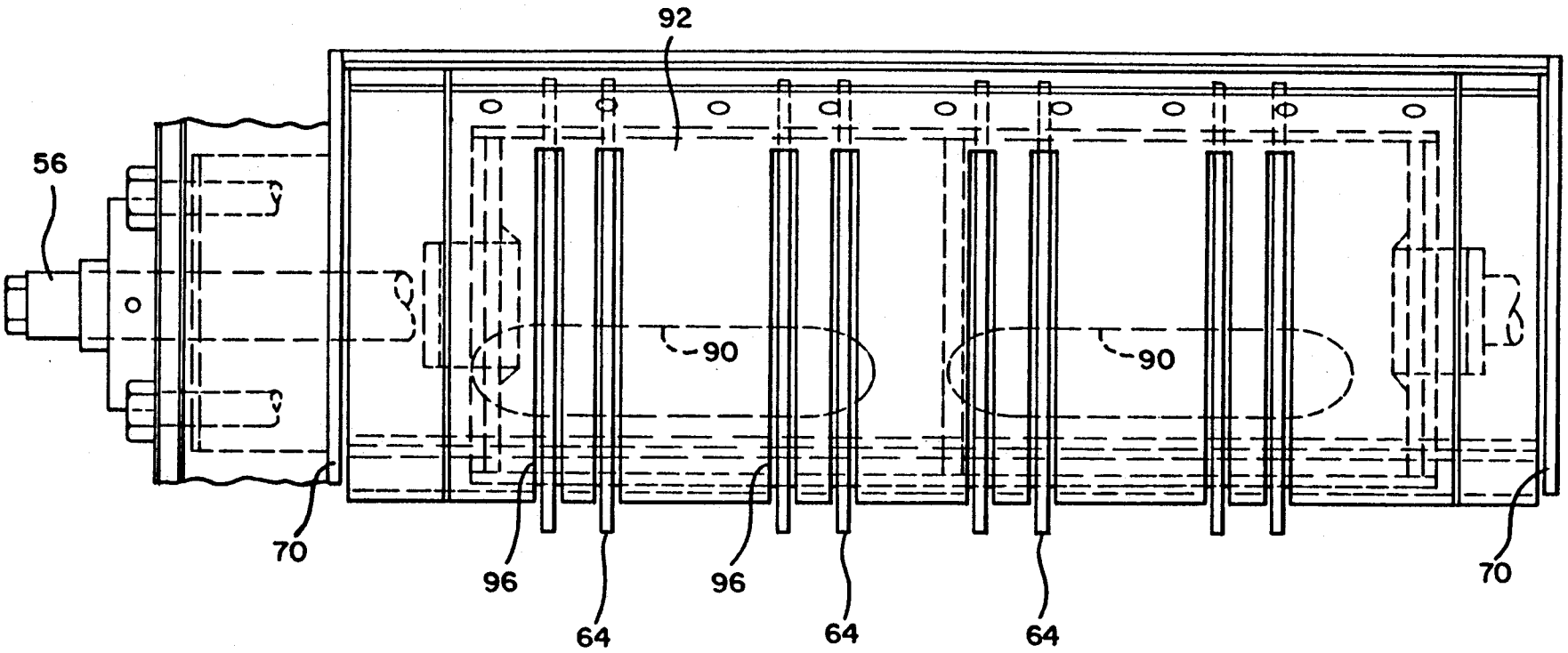
FIG. 4 is a plan view of one roller and a roller cover of the furnace.
Figure 5:
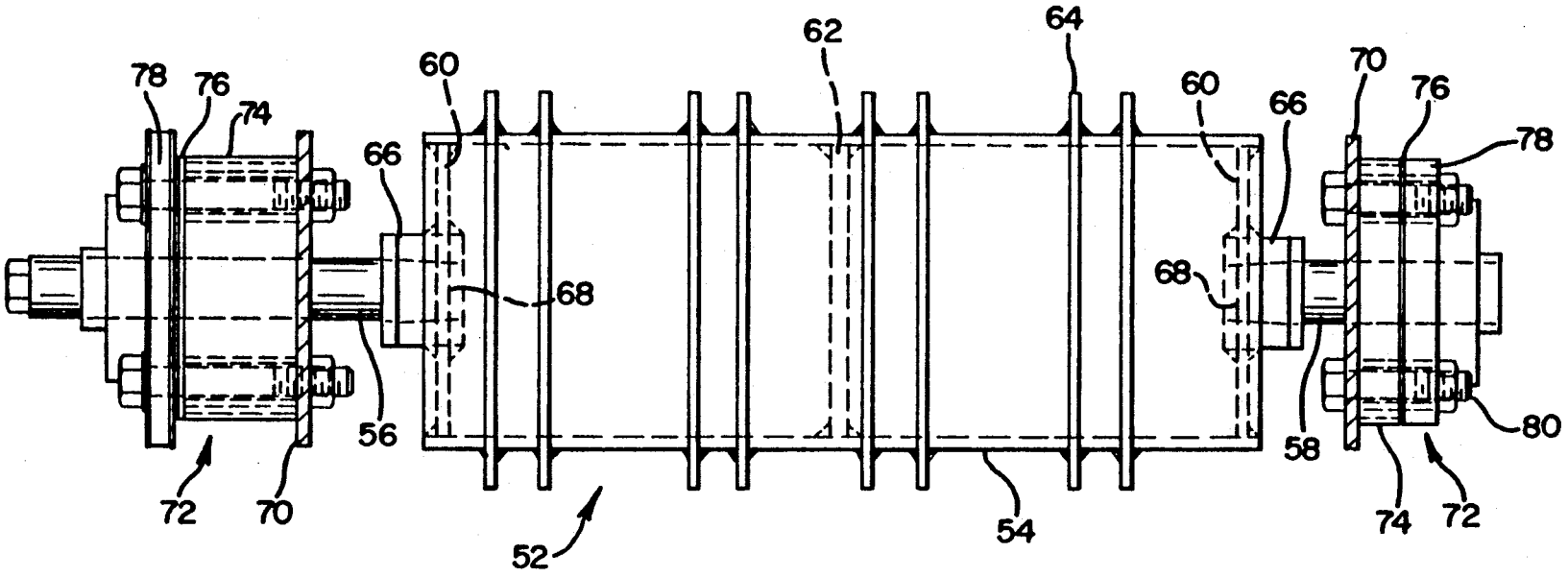
FIG. 5 is a plan view of one roller of the furnace.

In FIGS. 4 and 5, front and rear plates of the combustion section are designated by the reference 70, with just part of each plate being shown. Insulated bearing mounts 72 are provided on the end plates. These bearing units are generally similar.

A mounting box 74 is filled with lightweight, low density insulation material. A thermal break 76 separates a bearing unit 78 from the mounting box. The bearing unit has a cast housing with appropriate mounting holes. Conventional nuts and bolts 80 clamp the mounting box, thermal break and bearing units to the end plates.

The left hand bearing mount is generally similar. However, the mounting box is somewhat longer axially. Also, the forward stub shaft projects out to the front, or left as viewed in FIG. 5, for mounting a drive sprocket as discussed below.

Figure 3:
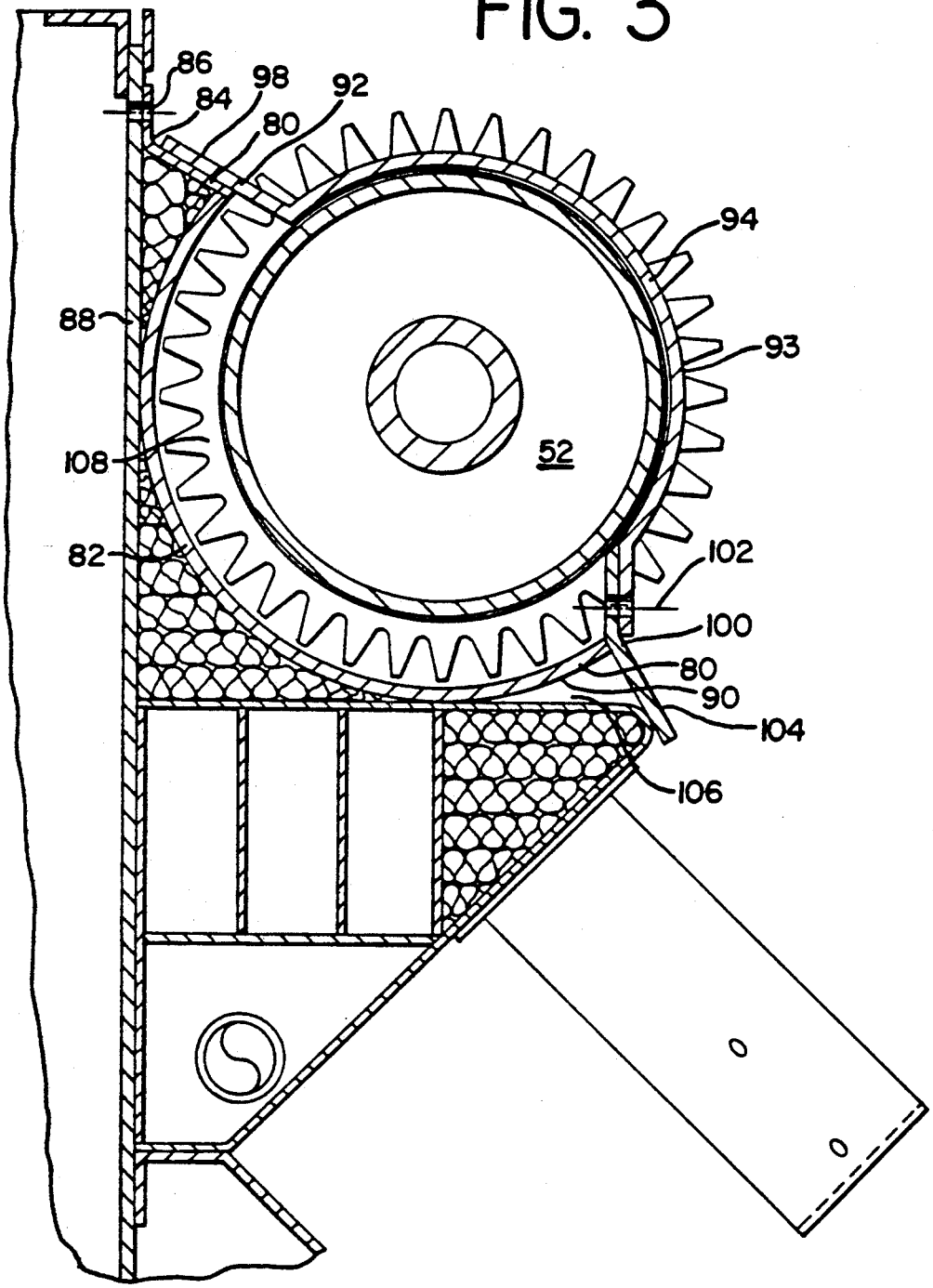
FIG. 3 is a vertical sectional view along the line 3—3 on a larger scale of one roller of the furnace of FIGS. 1 and 2.

With regard to the profiles of the toothed annular discs 64, each of these may be stamped from sheet steel, of, for example, 3/16 inch thickness. As shown in FIG. 3, each annular disc may have 36 teeth, i.e. with the teeth at 10° spacinqs. The internal diameter of each disc would be slightly larger than the external diameter of the main cylindrical body 54. For example, a 1/16 inch difference in diameter may be provided, where the circular body has an external diameter of 6⅜ inches. The external diameter of the disc would then be 8 inches, with the teeth having a depth of ½ inch. It is to be appreciated that a variety of different teeth profiles, sizes and spacings can be used. It may well prove more efficient to use different configurations, depending upon whether a furnace is particularly intended for soft or hard wood, or wood of a particular size.

As shown in FIGS. 4 and 5, the annular discs are provided in pairs spaced along the length of the main body. Each pair of discs may be spaced by ⅞ inch, with the pairs at either end spaced by 4⅛ inch. The central two pairs of discs are spaced by 3½ inches. The cylindrical main body would then be 17 inches long.

Turning now to the structure surrounding each roller 52, there is provided a roller backing plate 80 for each roller, as shown in FIG. 3. The roller backing plate 80 has a central arcuate portion 82 covering the annular discs. At the top, this is welded to another plate, 84 of lesser thickness, which includes a row of holes 86 for bolting it to a side plate 88 of the combustion section. At its lower end, the arcuate portion includes an opening 90 for debris, as discussed below.

Covering the roller is a roller guard or cover 92. This includes a corresponding arcuate portion 94 adjacent the main cylindrical body 54. As shown in FIG. 1, this arcuate portion includes slots 96 for the toothed annular discs. That is, there are arcuate guard plates 93 between neighboring rows of teeth 95, 97, for example, to substantially cover each roller and leave the teeth exposed. The annular portion is welded to an upper plate 98 and bolted to a lower plate 100, as indicated at 102. The lower plate includes an opening 104 for debris at its lower end. The plates 18 forming the combustion chamber define a horizontal ledge 106. The lower plate merely rests against the ledge to allow for thermal expansion and contraction and manufacturing tolerances.

It will be appreciated that reasonable clearances have to be provided between the slots and annular discs to accommodate thermal expansion and contraction and manufacturing tolerances. Also, a substantial arcuate space 108 is left between the cylindrical main body 54 of the roller and the arcuate portion 82 of the backing plate. Consequently, debris, e.g. small pieces of wood, bark etc. can fall down between the roller and the backing plate. The openings 90, 104 are intended to allow this debris to fall out into the combustion chamber. If necessary, to promote this action, the inner edge of the ledge can be sloped downwards.

The configuration of the openings 90, 104 are shown in FIGS. 4 and 1 respectively. Thus, the openings 90 are relatively large, and two of them are provided. Similarly, a pair of the openings 104 is provided.

To drive the rollers, drive sprockets 110 are mounted on the ends of the shafts. A drive motor 112 is mounted at the forward end of the combustion section and has a respective drive sprocket 114. A drive chain 116 extends around the sprockets 110, 114, the chain extending between the sprockets 110, 110' to provide an operable connection between the rollers such that rotation of a first of the rollers causes rotation of the second roller in the same direction. The motor may be an electric motor. The transmission has to be capable of transmitting a relatively low speed drive at a high torque. Instead of the motor, for manual operation a simple hand crank could be used.

For the combustion chamber, the slot 26 serves as an exhaust outlet, through which the exhaust gases are drawn. The downdraft exhaust assists ash removal and separation, while the slot provides uniform combustion and flow geometry. The gases are then passed to a heat exchanger unit (not shown), where further combustion occurs and heat is exchanged with the ambient air passed through the heat exchanger.

In use, the log magazine 4 is charged with a suitable number of logs 120, as shown in FIG. 2. The motor 112 can then be actuated, to ensure that some of the logs fall down into the combustion chamber 14. Thus, the rollers can alternately be rotated in one direction and the other by a matter of a few revolutions. As shown for the top two logs, they can bridge the rollers 52, preventing entry of them into the combustion chamber 14. By this actuation of the motor, the logs should enter into the combustion chamber.

Combustion is then commenced by means of an electric heater (not shown). At this time, the blower fans 12 are operated to supply combustion air through the air supply ducts 32. Simultaneously, exhaust gases are drawn off through the heat exchanger. Once combustion has started, then the heater is turned off, to maximize its life.

As combustion continues, the logs are consumed and reduce in size. Thus, as shown in FIG. 2, the lower logs are smaller than the upper ones, to indicate that they have been partially consumed. When the logs are small enough, they will fall down below the air supply ducts 32 and ultimately the remains of the log will fall through the slot 26 for ash into the ash drawer 16.

At regular intervals, the motor 112 will be actuated to jostle the logs to cause them to fall into the combustion chamber. On each occasion, the rollers will be rotated by small amounts in each direction, to ensure that the logs move downwards.

It is to be noted that the rollers 52 preferably rotate in the same direction, and not the opposite direction. Thus, they both either rotate clockwise or anti-clockwise, as viewed in FIG. 2. It has been found that this helps to prevent jamming of the logs, and destabilizes any bridge or arch of logs formed between the rollers. Rotation in opposite directions so that both rollers simultaneously urge logs upwards may also prove useful for clearing jams in some circumstances. If they were rotated in opposite directions, then either they would both be urging the logs upwards which would not encourage the logs to fall between the rollers, or they would both be urging logs on both sides downwards into the throat 53 between them, causing greater wedging and jamming. Here, if one roller is urging one or more logs on one side downwards, then any logs on the other side would be lifted upwards by the adjacent roller. This provides a gentle jostling action, which causes the logs to fall downwards under the influence of gravity and maintain the combustion chamber full. The two rollers are shown to be concurrently rotated, however it is understood that the rollers may also be operated sequentially.

The rollers serve to regulate the flow of the logs down into the combustion chamber. Thus, although the throat is wider than the largest log anticipated, it should not be excessively wider. Consequently, in the absence of roller motion, it is expected that only one or two logs will fall down before further logs become jammed and form a bridge or arch above the rollers.

Logs can thus be supplied to the combustion chamber at desired intervals and at a desired rate, by operating the mechanism for a certain time at the desired intervals.

The combustion is confined to the combustion chamber, since the log magazine or store is closed while combustion is underway. Thus, although smoke and heat may rise upwards to a certain extent into the log magazine, due to convection forces etc., no significant quantity of combustion air can rise upwards. This prevents the combustion zone from extending upwards and it is limited to that region below the rollers. The log magazine can be kept supplied with wood, as detailed in copending application No. 422,964.

As mentioned above, the openings 90, 104 should ensure that no debris from the logs clogs the operation of the rollers 52. Each time the rollers are actuated by the motor, this should further encourage debris to fall through these openings into the combustion chamber.

If desired, an automatic control could be provided for regulating the operation of the roller drive. Thus, the motor can be regulated, depending upon the flow rate of air through the device, indicative of the progress of air combustion. Also, sensors can be used to detect changes of temperature or weight at various points, to indicate when further combustion material is needed. Also, changes in the electrical characteristics of the drive motor could be measured to detect absence of logs through absence of drive load.

It is to be appreciated that the above description relates to a preferred embodiment of the present invention, and many variations are possible within the scope of the invention. The invention may be used with different types of material. In particular, whilst exemplary dimensions have been given for some components, the sizes and dimensions as well as materials, can be selected, depending upon each individual application.

What is claimed is:

1. A mechanism for feeding a bulk-discrete solid but not naturally free flowing material into a chamber, the mechanism comprising:

(a) first and second generally cylindrical rollers wherein each roller includes a plurality of teeth around its periphery for engaging the solid material provided by a plurality of annular discs mounted to the roller and spaced along the length thereof wherein the rollers are adapted to be mounted above the chamber and below a store for the material, the rollers being rotatably mounted, extending generally horizontally and parallel to one another and being spaced sufficiently apart to enable the material to fall between them but sufficiently close so that, in the absence of roller motion, the material tends to bridge between the rollers; and (b) drive means for rotating the rollers.

2. A mechanism as claimed in claim 1 further comprising a guard plate for each roller, each guard plate covering the corresponding roller and having a plurality of slots through which the teeth of the corresponding roller extend for engaging the material.

3. A mechanism as claimed in claim 2, further comprising a backing plate for each roller, each backing plate extending around the corresponding roller on a side remote from the material with each backing plate and the corresponding guard plate substantially enclosing the corresponding roller.

4. A mechanism as claimed in claim 3, wherein each roller has one or more hollow portions, filled with insulation material.

5. A mechanism as claimed in claim 4, wherein each roller at either end is mounted by means of insulated bearing mounts.

6. A mechanism as claimed in claim 5, wherein each roller comprises stub shafts at either end and each insulated bearing mount comprises a mounting box filled with insulation.

7. A mechanism as claimed in claim 6 wherein each roller rotates symmetrically about an axis of rotation which runs through the center of the generally circular cross sections of each roller.

8. A mechanism as claimed in claim 7 wherein the rollers are rotated so that both rollers do not continuously and simultaneously urge the material downwards.

9. A mechanism as claimed in claim 8 wherein the rollers are rotated concurrently in the same direction.

10. A mechanism as claimed in claim 9 wherein the rollers are alternately rotated in opposite directions in an oscillating fashion.

11. A mechanism as claimed in claim 6 wherein the drive means is a sprocket assembly attached to each roller and a drive motor and includes a means for transmitting the power of the motor to the sprockets.

12. A mechanism as claimed in claim 1 further comprising a backing plate for each roller, each backing plate extending around the corresponding roller on a side remote from the material.

13. A mechanism as claimed in claim 12, wherein each roller includes a plurality of pairs of annular discs, each pair of discs being relatively closely spaced relatively far from adjacent pairs of annular discs.

14. A mechanism as claimed in claim 3 or 12, wherein the guard and backing plates include openings at the bottom thereof, to enable debris to fall out into the chamber.

15. A furnace comprising:

(a) a housing defining a combustion chamber in a lower part of the housing and a store for a bulk-discrete solid but not naturally free flowing fuel in an upper part of the housing;

(b) a roller mechanism, for feeding the fuel from the store to the combustion chamber in which first and second generally cylindrical rollers each having a plurality of teeth on its exterior to engage solid fuel wherein the teeth are provided by annular discs having toothed external peripheries, the annular discs being secured to each roller and spaced along the length thereof wherein the rollers are rotatably mounted in the housing and extend generally horizontally and parallel to one another, between the store and the combustion chamber, the rollers being spaced sufficiently apart to allow the fuel to fall between them into the combustion chamber, but sufficiently close so that, in the absence of roller motion, fuel tends to bridge between the rollers;

(c) drive means coupled to the rollers for rotating the rollers; so that both rollers do not continuously and simultaneously urge the fuel downwards;

(d) means for supplying air into the combustion chamber; and (e) an ash collection means disposed below the combustion chamber.

16. A furnace as claimed in claim 15 which includes, for each roller, a guard plate covering that roller, the guard plate including slots for the teeth.

17. A furnace as claimed in claim 15 further comprising:

(a) a guard plate for each roller, each guard plate covering a corresponding roller and having a plurality of slots through which the teeth of the corresponding roller extend for engaging the material; and (b) a backing plate for each roller, each backing plate extending around the corresponding roller with each backing plate and the corresponding guard plate substantially enclosing the corresponding roller.

18. A furnace as claimed in claim 17, wherein, for each roller, the backing and guard plates include openings through which debris can fall into the combustion chamber.

19. A furnace as claimed in claim 18, wherein the means for supplying air includes an air supply passageway beneath each roller and a plurality of air supply ducts having a plurality of openings opening into the combustion chamber, the air supply ducts being connected to the air passageways.

20. A furnace as claimed in claim 19, wherein the bottom of the combustion chamber is defined by fire bricks which are inclined inwardly and downwardly from the horizontal plane, with the air supply ducts being mounted above those fire bricks.

21. A furnace as claimed in claim 20 wherein the bottom fire bricks define a slot through which combustion gases and combustion materials can pass.

22. The furnace of claim 15 wherein the store has side walls parallel to the rollers and a top surface such that an interior angle defined by each of the side walls and the top surface is greater than about 90°.

23. A furnace as claimed in claim 17 or 18, wherein the guard plate is secured only along one edge thereof, to allow for thermal expansion and contraction, and insulation is provided behind the backing plate.

24. A furnace as claimed in claim 18, wherein, for each roller, the annular discs are provided in pairs, with each pair of annular discs being relatively closely spaced, and each pair of annular discs being relatively distantly spaced from the adjacent pairs of annular discs.

25. A mechanism for feeding bulk-discrete solid but not naturally free flowing material into a chamber, the mechanism comprising:

(a) first and second rollers rotatably mounted above the chamber, extending generally horizontally and parallel to one another;

(b) wherein the rollers are spaced sufficiently apart to enable the material to fall between them but sufficiently close so that, in the absence of roller motion, the material tends to bridge between the rollers;

(c) wherein there is an operable connection means between the rollers whereby rotation of the first roller in a first direction causes rotation of the second roller in the same direction; and (d) drive means connected to at least one of said rollers for rotation thereof.

26. The mechanism of claim 25 wherein at least one of the rollers is provided with a plurality of teeth around its periphery for engaging the solid material.

27. The mechanism of claim 26 wherein each of the rollers is generally cylindrical.

28. The mechanism of claim 27 wherein at least one of the rollers includes a plurality of annular discs mounted thereto and spaced along its length, the annular discs providing the teeth.

29. The mechanism of claim 28 wherein each roller is generally cylindrical and includes a plurality of annular discs mounted thereto and spaced along the length thereof, the annular discs providing the teeth.

30. The mechanism of claim 29 wherein each roller is provided with a guard plate between neighboring annular discs to substantially cover the roller and leave the teeth exposed.

31. The mechanism of claim 26 wherein the teeth are arranged in a plurality of circumferential rows on the roller and further comprising a guard plate between neighboring rows of teeth to substantially cover the roller and leave the teeth exposed.

32. The mechanism of claim 31 wherein each guard plate is arcuate.

33. The mechanism of claim 25 wherein the rollers are rotated so that both rollers do not continuously and simultaneously urge the material downwards.

34. The mechanism of claim 33 wherein the rollers are alternately rotated in opposite directions in an oscillating fashion.

35. The mechanism of claim 25 wherein the operable connection means comprises a sprocket assembly attached to each roller and a chain means extending therebetween.

36. A furnace comprising:

(a) a housing defining a combustion chamber in a lower part of the housing and a store for bulk-discrete solid but not naturally free flowing fuel in an upper part of the housing;

(b) a roller mechanism, for feeding the fuel from the store to the combustion chamber in which first and second rollers are rotatably mounted in the housing and extend generally horizontally and parallel to one another, between the store and the combustion chamber, the rollers being spaced sufficiently close so that, in the absence of roller motion, fuel tends to bridge between the rollers;

(c) wherein there is an operable connection means between the rollers whereby rotation of the first roller in a first direction causes rotation of the second roller in the same direction;

(d) drive means coupled to at least one of the rollers for rotating the rollers;

(e) means for supplying air into the combustion chamber; and (f) an ash collection means disposed below the combustion chamber.

37. The furnace of claim 36 wherein at least one of the rollers provides a plurality of teeth around its periphery for engaging the solid material.

38. The furnace of claim 37 wherein each of the rollers is generally cylindrical.

39. The furnace of claim 38 wherein at least one of the rollers includes a plurality of annular discs mounted thereto and spaced along its length, the annular discs providing the teeth.

40. The furnace of claim 39 wherein each roller is generally cylindrical and includes a plurality of annular discs mounted thereto and spaced along the length thereof, the annular discs providing the teeth.

41. The furnace of claim 40 wherein each roller is provided with a guard plate between neighboring annular discs to substantially cover the roller and leave the teeth exposed.

42. The furnace of claim 37 wherein the teeth are arranged in a plurality of circumferential rows on the roller and further comprising a guard plate between neighboring rows of teeth to substantially cover the roller and leave the teeth exposed.

43. The furnace of claim 42 wherein each guard plate is arcuate.

44. The furnace of claim 36 wherein the rollers are rotated so that both rollers do not continuously and simultaneously urge the material downwards.

45. The furnace of claim 44 wherein the rollers are alternately rotated in opposite directions in an oscillating fashion.

46. The furnace of claim 36 wherein the operable connection means comprises a sprocket assembly attached to each roller and a chain means extending therebetween.

47. The furnace of claim 36 wherein the store has side walls parallel to the rollers and a top surface such that an interior angle defined by each of the side walls and the top surface is greater than about 90°.

48. A furnace comprising:

(a) a housing defining a combustion chamber in a lower part of the housing and a store for a bulk-discrete solid but not naturally free flowing fuel in an upper part of the housing;

(b) a roller mechanism, for feeding the fuel from the store to the combustion chamber in which first and second rollers are rotatably mounted in the housing and extend generally horizontally and parallel to one another, between the store and the combustion chamber, the rollers being spaced sufficiently apart to allow the fuel to fall between them into the combustion chamber, but sufficiently close so that, in the absence of roller motion, fuel tends to bridge between the rollers;

(c) drive means connected to at least one of the rollers for rotating the roller to which it is connected so that both rollers do not continuously and simultaneously urge the fuel downwards;

(d) means for supplying air into the combustion chamber;

(e) an ash collection means disposed below the combustion chamber;

(f) wherein the roller connected to the drive means includes a plurality of rows of teeth around its periphery for engaging the solid material; and (g) there is a guard plate between neighboring rows of teeth to substantially cover the roller and leave the teeth exposed.

49. The furnace of claim 48 wherein each guard plate is arcuate.

50. The furnace of claim 49 wherein each roller is connected to a drive means.

* * * * *

UNITED STATES PATENT AND TRADEMARK OFFICE

CERTIFICATE OF CORRECTION

PATENT NO. : 5,074,225

DATED : December 24, 1991

INVENTOR(S) : A. Stephen Petrie

It is certified that error appears in the above-indentified patent and that said Letters Patent is hereby corrected as shown below:

In column 5, line 19, after "422,964" insert --.--.

Col. 9, claim 6, line 4, after "insulation" insert --material, a thermal break, a bearing unit separated from the mounting box by the thermal break and in which a respective stub shaft is mounted, and securing means securing the mounting box, thermal break and bearing unit together--.

Signed and Sealed this

Twenty-sixth Day of April, 1994

Bruce Lehman

*Attest:*

BRUCE LEHMAN

*Attesting Officer*

*Commissioner of Patents and Trademarks*